US006912999B2

(12) United States Patent
Miyamoto et al.

(10) Patent No.: US 6,912,999 B2
(45) Date of Patent: Jul. 5, 2005

(54) METHOD OF CONTROLLING FUEL INJECTION IN INTERNAL COMBUSTION ENGINE

(75) Inventors: Yoshiji Miyamoto, Tokyo (JP); Toshihiro Kobayashi, Tokyo (JP)

(73) Assignee: Nissan Kohki Co., Ltd., Kanagawa Prefecture (JP)

( * ) Notice: Subject to any disclaimer, the term of this patent is extended or adjusted under 35 U.S.C. 154(b) by 0 days.

(21) Appl. No.: 10/861,841

(22) Filed: Jun. 4, 2004

(65) Prior Publication Data

US 2004/0244777 A1 Dec. 9, 2004

(30) Foreign Application Priority Data

Jun. 5, 2003 (JP) ..... 2003-160970

(51) Int. Cl.[7] ..... F02D 41/10; F02D 41/00
(52) U.S. Cl. ..... 123/492; 123/478; 123/480
(58) Field of Search ..... 123/472, 478, 123/480, 490, 492

(56) References Cited

U.S. PATENT DOCUMENTS 4,186,708 A * 2/1980 Bowler ..... 123/472
4,235,205 A * 11/1980 Fukui et al. ..... 123/472
4,256,075 A * 3/1981 Fukui et al. ..... 123/478
4,319,327 A * 3/1982 Higashiyama et al. ..... 123/492
4,727,490 A * 2/1988 Narita et al. ..... 701/65

* cited by examiner

*Primary Examiner*—Tony M. Argenbright

(57) ABSTRACT

A method of controlling fuel injection is disclosed which enables highly accurate fuel injection and an enhanced durability of fuel injection valves in an internal combustion engine using an SPI system. The engine has a plurality of fuel injection valves disposed in an intake passage on an upstream side of a collector portion of an intake manifold of the internal combustion engine so that fuel is supplied to a plurality of cylinders of the engine by fuel injection from the fuel injection valves. The method includes alternately operating the plurality of fuel injection valves so as to supply the fuel when an intake airflow is a low flow rate equal to or less than a predetermined value, and simultaneously operating the plurality of fuel injection valves so as to supply the fuel when the intake airflow is a high flow rate more than the predetermined value.

7 Claims, 3 Drawing Sheets

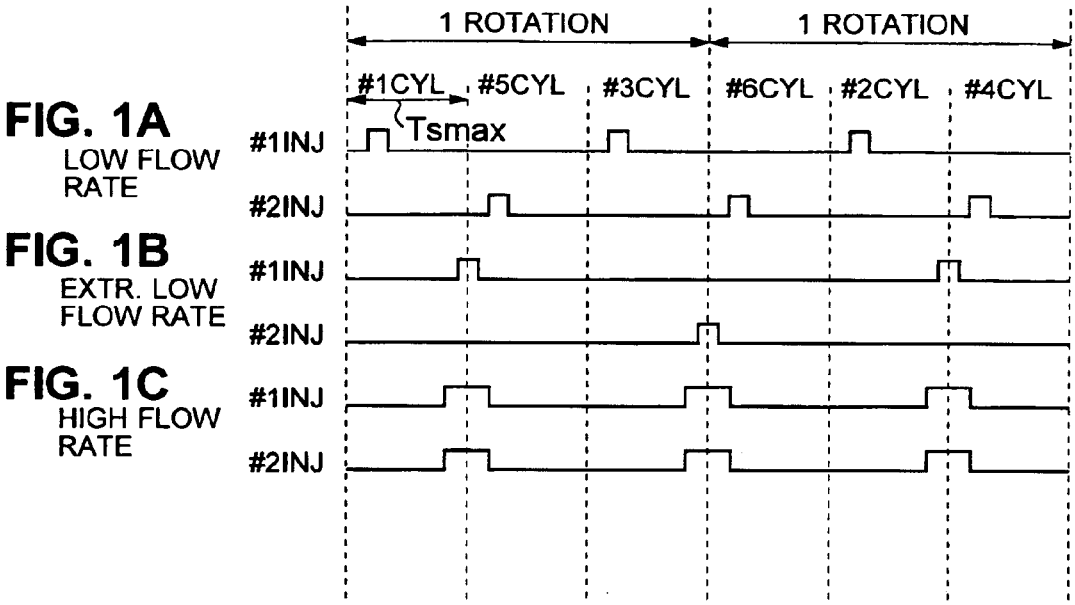
FIG. 2
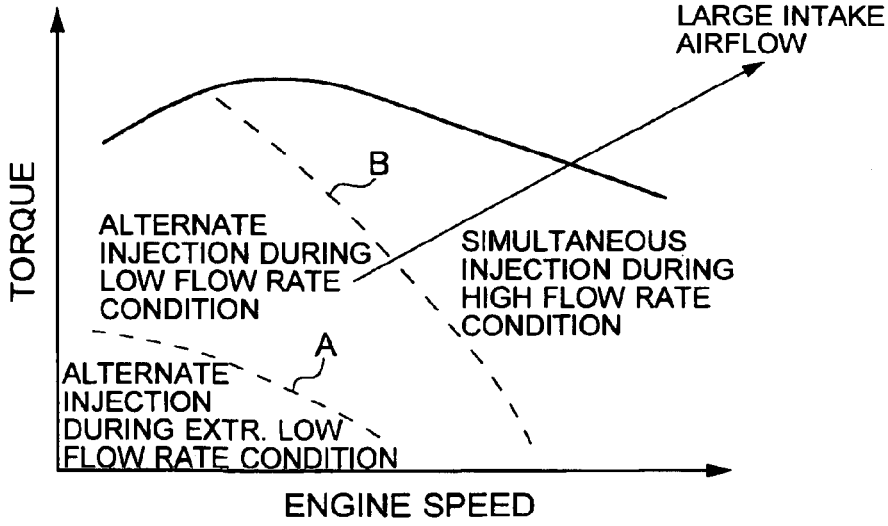

PRIOR ART
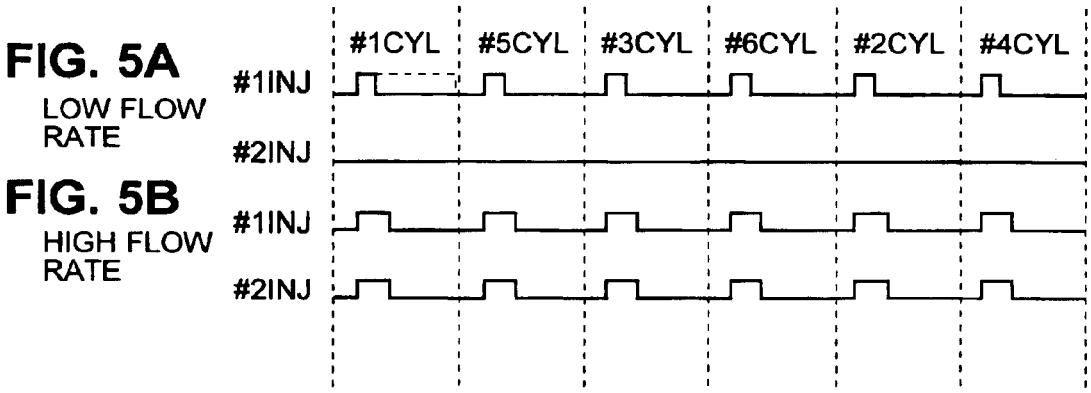

METHOD OF CONTROLLING FUEL INJECTION IN INTERNAL COMBUSTION ENGINE

BACKGROUND OF THE INVENTION

1. Field of the Invention

The present invention relates to a method of controlling fuel injection in an internal combustion engine which employs a single point injection system for supplying fuel to a plurality of cylinders by a single fuel injection operation of a plurality of fuel injectors or fuel injection valves disposed on an upstream side of a collector portion of an intake manifold of the internal combustion engine.

2. Description of the Related Art

There have been conventionally a single point injection (SPI) system in which a fuel injection valve is disposed on an upstream side of a collector portion of an intake manifold of an internal combustion engine so as to supply fuel to each of cylinders and a multi point injection (MPI) system in which one fuel injection valve is provided in each of the cylinders so as to supply fuel to a respective one of the cylinders.

The SPI system is employed in some internal combustion engines at present because the SPI system has a simpler structure than that of the MPI system, and the SPI system is frequently used, for example, in an engine of a fork lift truck or the like.

In general, a fuel injection apparatus of an internal combustion engine employing the SPI system is provided therein with a single fuel injection valve so as to carry out fuel injection in correspondence to an operating condition of the engine by controlling a fuel injection time.

In the case where the injection time is varied in correspondence to the operating condition on the basis of the injection start timing of the fuel injection valve, if the fuel injection time is increased or reduced due to dispersion of an engine control unit or the like and the fuel injection start timing is unchanged under the same operating condition, a distribution ratio of the fuel to be supplied to each of the cylinders is disequilibrated. In other words, some cylinders having a lean fuel mixture and others having a rich fuel mixture come into existence, resulting in some disadvantages.

Accordingly, there has been proposed a method of controlling an injection operation by calculating an intermediate time between a fuel injection start and a fuel injection end and determining the fuel injection start timing on the basis of the intermediate time of the fuel injection. Such a method is disclosed in Japanese Patent Application Laid-Open Publication No. 10-196441.

In general, the SPI system employs a single injector for controlling fuel injection. In the case where the SPI system is used in a large displacement engine or the like, the injector is required to have a large capacity. However, there is a problem that the large capacity causes a reduction in the ability to precisely set the fuel injection amount.

Further, although it may not be regarded as a complete SPI system, Japanese Patent Application-Laid-Open Publication No. 5-87021 discloses a control method which is constructed in such a manner that a fuel injection valve is provided in each of cylinders and an additional fuel injection valve is disposed near a collector portion of an intake manifold, whereby fuel is injected and supplied only from the fuel injection valve provided in each of the cylinders in the case of a low load, and the fuel is injected and supplied from both the fuel injection valve provided in each of the cylinders and the additional fuel injection valve provided near the collector portion of the intake manifold in the case of a high load.

It is also known to control fuel injection in the SPI system in correspondence to a fluctuation of the load by using two fuel injection valves, as shown in FIGS. 5A and 5B by way of example.

This technique, which is used in, for example, a six-cylinder engine, is constructed so as to control a fuel injection amount on the basis of measured intake airflow information from an air flow meter incorporated in a fuel injection control apparatus. In this technique, only one of the two fuel injection valves injects fuel so as to sequentially supply the fuel to each of the cylinders in the case of a low flow rate, and the two fuel injection valves are simultaneously operated so as to sequentially supply the fuel to each of the cylinders in the case of a high flow rate. In FIGS. 5A and 5B. for example, reference symbols #1CYL to #6CYL denote the first cylinder to the sixth cylinders, respectively, and reference symbols #1INJ and #2INJ denote the first and second fuel injection valves or injectors, respectively.

Further, in addition to the technique mentioned above, there is a method of simultaneously operating two fuel injection valves every time regardless of the intake airflow rate.

However, in the case of the above mentioned technique in which the control is executed in correspondence to the fluctuation of the load by using two fuel injection valves in the SPI system, if only one fuel injection valve is operated in the case of the low flow rate, said only one fuel injection valve is used very often, so that durability thereof is deteriorated. Further, if the two fuel injection valves are always operated at the same time, the ability to precisely set the fuel amount in the case of the low flow rate becomes low and thus the precision of the fuel injection is lowered, so that the fuel distribution to each of the cylinders is deteriorated.

SUMMARY OF THE INVENTION

It is an object of the present invention to provide a method of controlling fuel injection which is capable of improving the precision of fuel injection and a fuel distribution, and which is capable of enhancing the durability of a fuel injection valve in an internal combustion engine using an SPI system.

In order to achieve the object mentioned above, the present invention has been made. In accordance with the present invention, there is provided a method of controlling fuel injection in an internal combustion engine in which a plurality of fuel injection valves are disposed in an intake passage on an upstream side of a collector portion of an intake manifold of the internal combustion engine so that fuel is supplied to a plurality of cylinders of the internal combustion engine by fuel injection from the fuel injection valves. The method comprises: alternately operating the plurality of fuel injection valves so as to supply the fuel when an intake airflow is a low flow rate equal to or less than a predetermined value; and simultaneously operating the plurality of fuel injection valves so as to supply the fuel when the intake airflow is a high flow rate more than the predetermined value.

In a preferred embodiment of the present invention, the number of the fuel injection valves is two.

In a preferred embodiment of the present invention, the alternately operating the plurality of fuel injection valves includes setting a second predetermined value of the intake airflow which is smaller than the predetermined value, an amount of the fuel required for one of the cylinders is injected from each of the fuel injection valve at every predetermined rotational interval when the intake airflow is between the predetermined value and the second predetermined value, and an amount of the fuel required for two of the cylinders is injected from each of the fuel injection valves at every rotational interval which is longer than the predetermined rotational interval when the intake airflow is smaller than the second predetermined value.

In a preferred embodiment of the present invention, the internal combustion engine is one that is mounted on a fork lift truck.

In the case where the method of the present invention is applied to a six-cylinder internal combustion engine, when the intake airflow is a low flow rate, an amount of the fuel required for one cylinder is injected alternately from the plurality of fuel injection valves every one-third rotation of the internal combustion engine, and when the intake airflow is an extremely low flow rate, an amount of the fuel required for two cylinders is injected alternately every two-thirds rotation of the internal combustion engine, thereby executing an alternate injection control. Further, when the intake airflow is a high flow rate more than the predetermined value, an amount of the fuel required for two cylinders is supplied simultaneously from the plurality of fuel injection valves every two-thirds rotation of the internal combustion engine, thereby executing a simultaneous injection control.

BRIEF DESCRIPTION OF THE DRAWINGS

FIGS. 1A to 1C are time charts showing a state in which fuel is injected into a six-cylinder internal combustion engine from two fuel injection valves in an embodiment of a method of controlling fuel injection in an internal combustion engine in accordance with the present invention, wherein FIG. 1A shows a case that an intake airflow is a low flow rate, FIG. 1B shows a case that the intake airflow is an extremely low flow rate, and FIG. 1C shows a case that the intake airflow is a high flow rate;

FIG. 2 is a graph showing a changeover point for changing a fuel injection control on the basis of the intake airflow in the relationship between a torque, and an engine speed;

FIGS. 5A and 5B are time charts for a conventional method of controlling fuel injection in an internal combustion engine in accordance with an SPI system.

DETAILED DESCRIPTION OF THE INVENTION

A description will be given below of an embodiment in accordance with the present invention with reference to the accompanying drawings.

Figure 3:
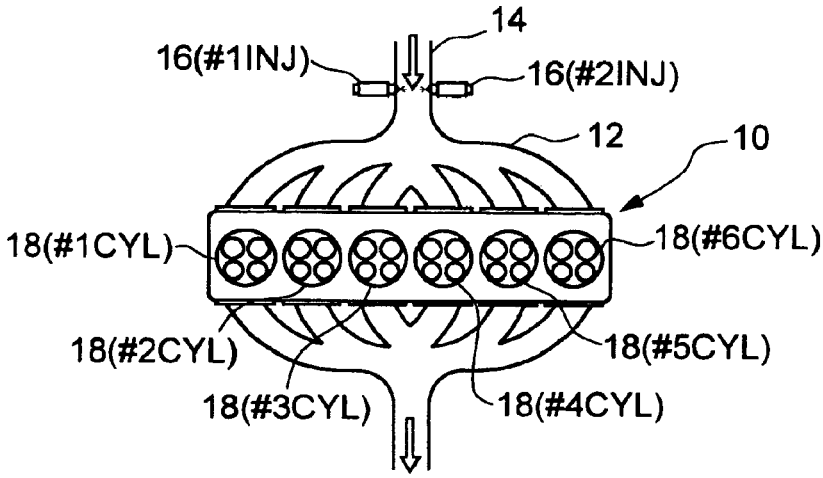
FIG. 3 is a schematic view showing an internal combustion engine to which the method of controlling fuel injection in accordance with the present invention is applied.

Referring first to FIG. 3, an internal combustion engine to which a method of controlling fuel injection in accordance with the present invention is applied is shown. As shown in FIG. 3, an internal combustion engine 10 mounted on a fork lift truck or the like includes a plurality of, for example, two fuel injection valves 16 and 16 which are disposed in an intake passage 14 on an upstream side of a collector portion of an intake manifold 12 thereof so that fuel is supplied to a plurality of, for example, six cylinders 18 (#1CYL to #6CYL) of the internal combustion engine 10 by fuel injection from the fuel injection valves 16 and 16.

Figure 4:
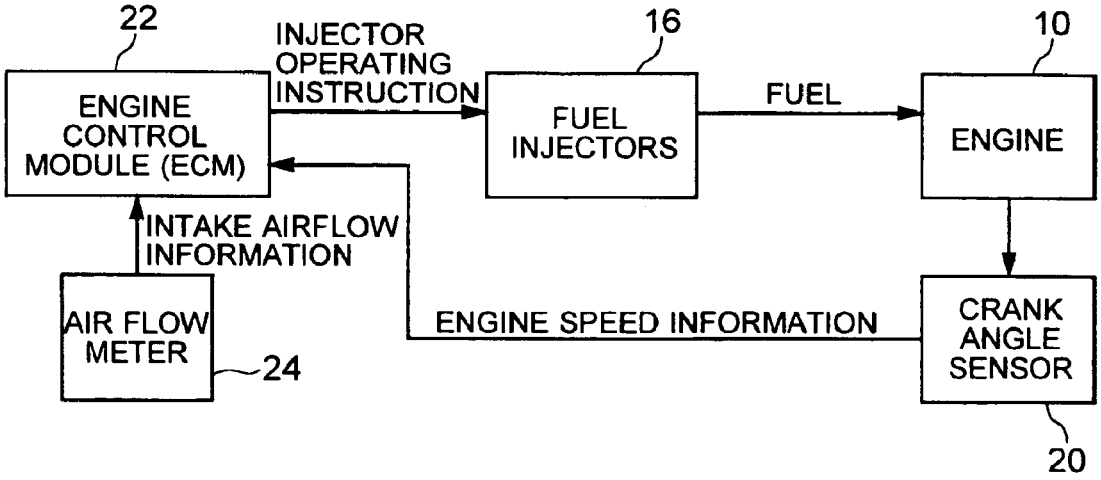
FIG. 4 is a schematic block diagram of an apparatus for carrying out the method of controlling fuel injection in the internal combustion engine.

Further, an apparatus for carrying out the method of controlling fuel injection, as schematically shown in FIG. 4, is provided with a crank angle sensor mounted to the internal combustion engine 10 so as to input rotational speed information of the engine 10 to an ECCS (electronic concentrated engine control system) control unit or engine control module (ECM) 22. Simultaneously, intake airflow information is input to the ECM 22 from an air flow meter 24 disposed near an air intake port. The ECM 22 controls fuel injection of the fuel injection valves 16 and 16 to the engine 10 on the basis of the above mentioned information.

In the case where the intake airflow is, for example, a low flow rate, the fuel injection to the engine 10 is executed in such a manner, as shown in FIG. 1A, that when a first one (#1INJ) of the fuel injection valves 16 is operated, the fuel is supplied to the first cylinder 18 (#1CYL), and when a second one (#2INJ) of the fuel injection valves 16 is then driven, the fuel is supplied to the fifth cylinder 18 (#5CYL). Subsequently, when the first fuel injection valve 16 (#1INJ) is operated again, the fuel is supplied to the third cylinder 18 (#3CYL), and when the second fuel injection valve 16 (#2INJ) is then operated, the fuel is supplied to the sixth cylinder 18 (#6CYL). Thereafter, when the first fuel injection valve 16 (#1INJ) is operated again, the fuel is supplied to the second cylinder 18 (#2CYL), and when the second fuel injection valve 16 (#2INJ) is then operated, the fuel is supplied to the fourth cylinder 18 (#4CYL). Thus, the first and second fuel injection valves 16 and 16 are alternately controlled by repeating the same operation mentioned above.

In other words, the injection control is executed in such a manner that an amount of the fuel required for one of the cylinders 18 is alternately injected from the two fuel injection valves 16 and 16 every one-third rotation of the engine 10. Further, in the case where the intake airflow is an extremely low flow rate (or the operational status of the engine falls within a region located below a curve A in FIG. 2), the injection control is executed in such manner that an amount of the fuel required for two of the cylinders 18 is alternately injected from the two fuel injection valves 16 and 16 every two-thirds rotation of the engine 10, as shown in FIG. 1B. These controls for the small intake airflow are referred to as an alternate injection control.

In this instance, a maximum injection time Tsmax that one of the fuel injection valves 16 can inject the fuel terminates just before the other of the fuel injection valves 16 starts to be operated (FIG. 1A).

In the case where, though each of the fuel injection valves 16 alternately injects the fuel for the maximum injection time Tsmax in correspondence to the rate of the intake airflow as mentioned above, it is impossible to meet a demand of the engine 10, the two fuel injection valves 16 and 16 are simultaneously operated by inputting a signal which indicates that the intake airflow information from the air flow meter 24 is a high flow rate to the ECM 22, whereby a sufficient amount of the fuel is injected. More particularly, as shown in FIG. 1C, an amount of the fuel required for two of the cylinders 18 is simultaneously injected from the two fuel injection valves 16 and 16 every two-thirds rotation of the engine 10. This control is called a simultaneous injection control. The demarcation between the simultaneous injection control and the alternate injection control is shown by a curve B in FIG. 2, on which the rate of the intake airflow is set to a predetermined rate or value. In this case, the predetermined rate of the intake airflow can be variously considered in correspondence to a displacement of the engine 10 and an injection amount of the fuel from the fuel injection valve 16, however, in calculation, it is determined as a necessary injection pulse width (Tinj) for one cylinder on the basis of the intake airflow information and the engine rotation information. The necessary injection pulse width (Tinj) can be calculated by use of the following mathematical expression:

$$Tinj = \frac{Qair(\text{l/m}) \times (2\ \text{rotations/1 cylinder})}{Neng(\text{rpm}) \times 6(\text{cylinders})} \times \frac{K(\text{cc/l})}{Kinj(\text{cc/m sec})},$$

where:

Qair=rate of the intake airflow detected by the air flow meter (1/min),

Neng=engine speed (rpm),

K=fuel/air amount conversion factor (cc/1),

Kinj=pulse width/flow rate conversion factor of the fuel injection valve (cc/msec).

As far as the necessary injection pulse width Tinj is within the injection maximum time Tsmax for the low flow rate shown in FIG. 1A, the alternate injection control is kept on, whereas when the necessary injection pulse width Tinj is equal to or greater than the injection maximum time Tsmax, the control is changed over to the simultaneous injection control.

In the embodiment mentioned above, the description is given of the case that the number of the cylinders is six and the number of the fuel injection valves is two, however, the structure is not particularly limited to this type. The present invention can be applied to the structure in which the SPI system is employed and a plurality of fuel injection valves are employed. Further, the fuel may be either or both of gasoline and an LPG, and the internal combustion engine can be applied to a motor vehicle, a power tiller and the like in addition to the fork lift truck.

As described above, in accordance with the present invention, the method includes the alternate injection control for alternately operating the plurality of fuel injection valves so as to supply the fuel in the case where the intake airflow is the low flow rate equal to or less than the predetermined value, and the simultaneous injection control for simultaneously operating the plurality of fuel injection valves so as to supply the fuel in the case where the intake airflow is the high flow rate more than the predetermined value, resulting in the precision of the fuel injection and the durability of the fuel injection valve being enhanced.

While the illustrative and presently preferred embodiment of the present invention has been described in detail herein, it is to be understood that the inventive concepts may be otherwise variously embodied and employed and that the appended claims are intended to be construed to include such variations except insofar as limited by the prior art.

What is claimed is:

1. A method of controlling fuel injection in an internal combustion engine in which a plurality of fuel injection valves are disposed in an intake passage on an upstream side of a collector portion of an intake manifold of the internal combustion engine so that fuel is supplied to a plurality of cylinders of the internal combustion engine by fuel injection from the fuel injection valves, comprising:

alternately operating the plurality of fuel injection valves so as to supply the fuel when an intake airflow is a low flow rate equal to or less than a predetermined value including setting a second predetermined value of the intake airflow which is smaller than the predetermined value; and simultaneously operating the plurality of fuel injection valves so as to supply the fuel when the intake airflow is a high flow rate more than the predetermined value wherein an amount of the fuel required for one of the cylinders is injected from each of the fuel injection valve at every predetermined rotational interval when the intake airflow is between the predetermined value and the second predetermined value, and an amount of the fuel required for two of the cylinders is injected from each of the fuel injection valves at every rotational interval which is longer than the predetermined rotational interval when the intake airflow is smaller than the second predetermined value.

2. The method of controlling fuel injection as defined in claim 1, wherein the number of the fuel injection valves is two.

3. The method of controlling fuel injection as defined in claim 2, wherein the internal combustion engine is one that is mounted on a fork lift truck.

4. The method of controlling fuel injection as defined in claim 1, wherein the internal combustion engine is one that is mounted on a fork lift truck.

5. The method of controlling fuel injection as defined in claim 1, wherein the predetermined value is determined when the injection pulse, width, Tinj, is equal to an injection maximum time and the following equation is satisfied:

$$Tinj = \frac{Qair(\text{l/m}) \times (2\ \text{rotations/1 cylinder})}{Neng(\text{rpm}) \times 6(\text{cylinders})} \times \frac{K(\text{cc/l})}{Kinj(\text{cc/m sec})},$$

where:

Qair=rate of the intake airflow detected by the air flow meter (1/min),

Neng=engine speed (rpm),

K=fuel/air amount conversion factor (cc/1),

Kinj=pulse width/flow rate conversion factor of the fuel injection valve (cc/msec).

6. A method of controlling fuel injection in an internal combustion engine in which a plurality of fuel injection valves are disposed in an intake passage on an upstream side of a collector portion of an intake manifold of the internal combustion engine so that fuel is supplied to a plurality of cylinders of the internal combustion engine by fuel injection from the fuel injection valves, comprising:

monitoring the intake airflow rate;

alternately operating the plurality of fuel injection valves so as to supply the fuel when an intake airflow is a low flow rate equal to or less than a predetermined value; and simultaneously operating the plurality of fuel injection valves so as to supply the fuel when the intake airflow is a high flow rate more than the predetermined value, wherein the predetermined value is determined when the injection pulse width, Tinj, is equal to an injection maximum time and the following equation is satisfied:

$$Tinj = \frac{Qair(\text{l/m}) \times (2\ \text{rotations/1 cylinder})}{Neng(\text{rpm}) \times 6(\text{cylinders})} \times \frac{K(\text{cc/l})}{Kinj(\text{cc/m sec})},$$

where:

Quair=rate of the intake airflow detected by the air flow meter (1/ mm),

Neng=engine speed (rpm),

K=fuel/air amount conversion factor (cc/1),

Kinj=pulse width/flow rate conversion factor of the fuel injection valve (cc/msec).

7. An apparatus for controlling fuel injection into a plurality of engine cylinders, comprising:

an intake passage for supplying air and fuel to the plurality of engine cylinders;

a plurality of fuel injection units operatively connected to the intake passage to enable a controlled injection of fuel;

air flow meter for monitoring air flow in the intake passage;

an engine speed sensor unit for monitoring the position of the cylinder; and an engine control module for controlling the plurality of fuel injection units in response to the monitored air flow and the position of the cylinders so that the plurality of fuel injection units are operated alternatively when the air flow rate is equal to or less than a predetermined value and operated simultaneously when the air flow rate is greater than a predetermined value, wherein the predetermined value is determined when the injection pulse width, Tinj, is equal to an injection maximum time and the following equation is satisfied:

$$Tinj = \frac{Qair(\text{l/m}) \times (2\ \text{rotations/1 cylinder})}{Neng(\text{rpm}) \times 6(\text{cylinders})} \times \frac{K(\text{cc/l})}{Kinj(\text{cc/m sec})},$$

where:

Quair=rate of the intake airflow detected by the air flow meter (1/mm),

Neng=engine speed (rpm),

K=fuel/air amount conversion factor (cc/1),

Kinj=pulse width/flow rate conversion factor of the fuel injection valve (cc/msec).

* * * * *